US012714169B1

(12) United States Patent
Guo

(10) Patent No.: US 12,714,169 B1
(45) Date of Patent: Aug. 25, 2026

(54) SWEATSHIRT WITH INTERNAL POCKET

(71) Applicant: Cove & Edgewater, LLC, Gardena, CA (US)

(72) Inventor: Yuehua Allen Guo, Palos Verdes Estates, CA (US)

(73) Assignee: Love & Edgewater LLC, Gardena, CA (US)

( * ) Notice: Subject to any disclaimer, the term of this patent is extended or adjusted under 35 U.S.C. 154(b) by 0 days.

(21) Appl. No.: 19/032,983

(22) Filed: Jan. 21, 2025

(51) Int. Cl.
*A41D 27/20* (2006.01)
*A41D 3/00* (2006.01)

(52) U.S. Cl.
CPC ..... *A41D 27/20* (2013.01); *A41D 3/005* (2013.01)

(58) Field of Classification Search
CPC . A41D 1/04; A41D 27/20; A41D 1/02; A41D 13/0058; A41D 27/204; A41D 27/205; A41D 13/0012; A41D 27/02; A41D 2400/48; A41D 2400/482; A41D 27/207; A41B 1/00
USPC ..... 2/94
See application file for complete search history.

(56) References Cited

U.S. PATENT DOCUMENTS 6,000,064 A * 12/1999 Alcone ..... A41D 27/20 2/248
8,402,562 B1 3/2013 Seddiki
8,566,963 B2 10/2013 Ryan
9,060,555 B1 6/2015 Harris et al.
D859,788 S 9/2019 Speciale et al.
11,026,457 B1 6/2021 Mayer
11,317,662 B2 5/2022 Watts
12,016,410 B2 6/2024 Boyd et al.
2007/0000030 A1* 1/2007 Toomey ..... A41D 27/20 2/247
2009/0158493 A1* 6/2009 Kim ..... A41D 3/005 2/243.1
2012/0144550 A1 6/2012 Nejad
2015/0181960 A1 7/2015 Goeglein
2016/0192722 A1 7/2016 Simeone
2017/0020215 A1 1/2017 Merritt

FOREIGN PATENT DOCUMENTS

DE 29905694 U1 * 6/1999 ..... A41D 27/20

OTHER PUBLICATIONS

Translation of DE-29905694-U1 (Year: 1999).*

* cited by examiner

*Primary Examiner* — Grady Alexander Nunnery
(74) *Attorney, Agent, or Firm* — Eric Karich; Karich & Associates

(57) ABSTRACT

A sweatshirt has main body that includes a front portion, a back portion, and a pair of side portions. A pair of opposed slits is formed in the front portion, each slit being adjacent one of the side portions. A tube of material extends to side edges that form side openings for accessing an internal pocket of the tube of material. The tube of material abuts an interior surface of the front portion of the sweatshirt, but is not fastened to the front portion except via the side edges, each of the side edges being sewn to a slit seam of one of the pair of opposed slits, such that the internal pocket can be accessed through the slits.

2 Claims, 3 Drawing Sheets

SWEATSHIRT WITH INTERNAL POCKET

BACKGROUND OF THE INVENTION

Field of the Invention

This invention relates generally to sweatshirts, and more particularly to sweatshirts with single front pockets.

Description of Related Art

Sweatshirts, particularly pullover hoodies, have become increasingly popular for both fashion and comfort, and typically have a very consistent construction. Most pullover hoodies include a front pocket in the form of an exterior panel of material sewn at top and bottom edges. The pocket is generally an obvious feature positioned near the bottom of the garment.

The prior art teaches an exterior pocket on the front of a sweatshirt. However, the prior art does not teach a sweatshirt having a single, central internal pocket in the form of a tube of material attached to slits of the sweatshirt. The present invention fulfills these needs and provides further advantages as described in the following summary.

SUMMARY OF THE INVENTION

The present invention teaches certain benefits in construction and use which give rise to the objectives described below.

The present invention provides a sweatshirt adapted to cover a person's torso. The sweatshirt includes a front portion, a back portion, and a pair of side portions together forming a main body that extends from an upper end to a lower end and has an interior surface and an exterior surface. A pair of opposed arm openings is formed in the side portions, a head opening is formed at the upper end, and a bottom opening is formed at the lower end. A pair of opposed slits is formed in the front portion, each slit being adjacent one of the side portions. A tube of material has a front surface and a rear surface connected with a top portion and a bottom portion, the tube of material extending to side edges that form side openings for accessing an internal pocket of the tube of material. The tube of material abuts the interior surface of the front portion of the sweatshirt, but is not fastened to the front portion except via the side edges, each of the side edges being sewn to a slit seam of one of the pair of opposed slits, such that the internal pocket can be accessed through the slits.

In one embodiment, the sweatshirt comprises the limitations of claim 1.

A primary objective of the present invention is to provide a sweatshirt with internal pocket having advantages not taught by the prior art.

Another objective is to provide a sweatshirt with internal pocket that includes tube of material attached at side edges to the sweatshirt.

In some embodiments, another objective is to provide a sweatshirt with an internal pocket that is supported by a liner that extends to the neck of the sweatshirt.

In some embodiments, a further objective is to provide a sweatshirt with an internal pocket that allows access via external slits.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a sweatshirt having an internal pocket for being worn on a person's torso.

Figure 1:
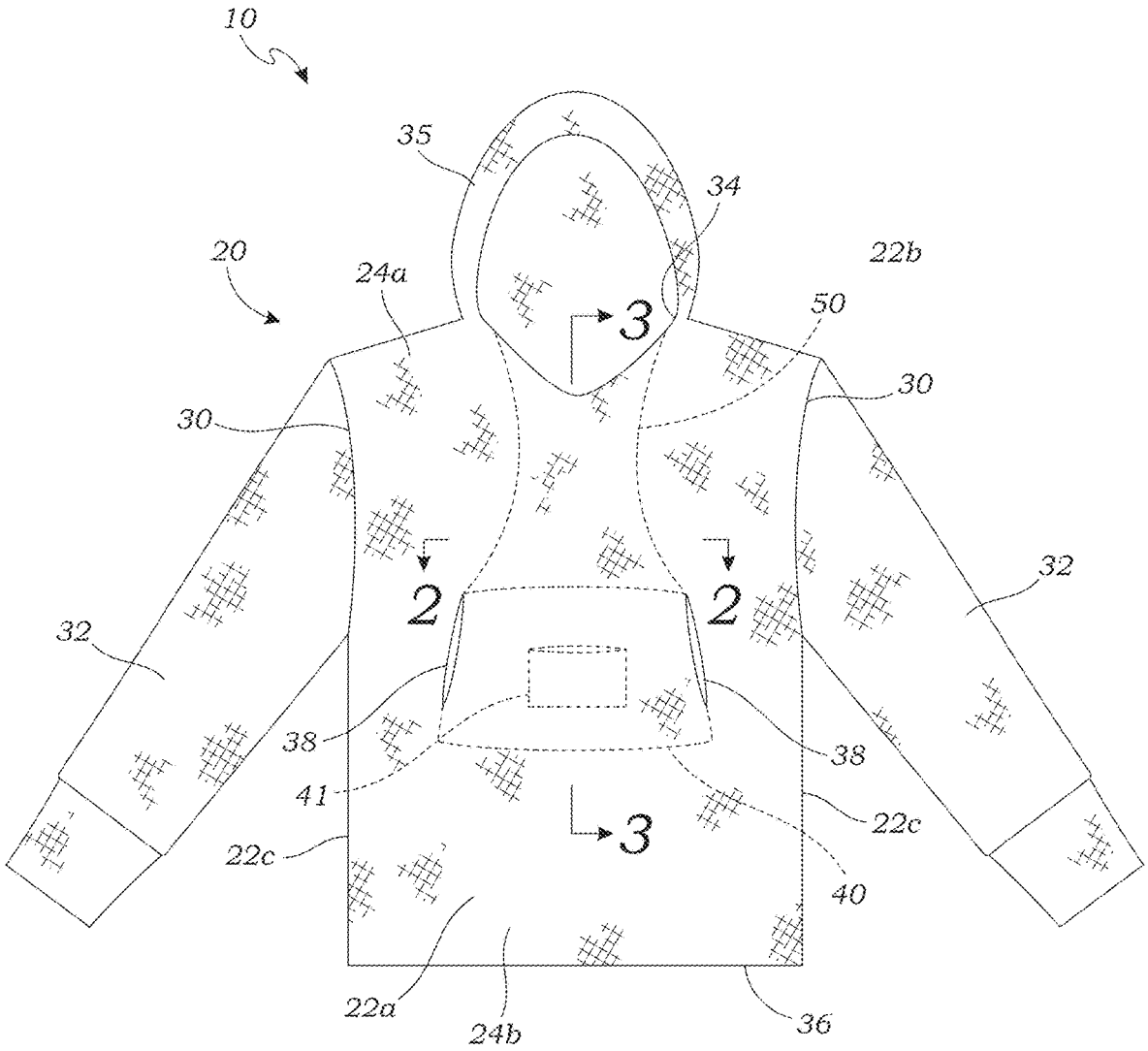
FIG. 1 is a perspective view of a sweatshirt with internal pocket according to one embodiment of the present invention.

FIG. 1 is a perspective view of a sweatshirt with internal pocket 10 according to one embodiment of the present invention. As shown in FIG. 1, the sweatshirt with internal pocket 10 comprises a front portion 22*a*, a back portion 22*b*, and a pair of side portions 22*c* together forming a main body 20 that extends from an upper end 24*a* to a lower end 24*b* and has an interior surface 26 and an exterior surface 28. A pair of opposed arm openings 30 is formed in the side portions 22*c*. In this embodiment, an arm sleeve 32 extends from each arm opening 30. The arm sleeve 32 may extend any length from the arm opening 30, as deemed suitable by the manufacturer. A head opening 34 is formed at the upper end 24*a*, wherein a hood 35 may extend from the head opening 34. Alternatively, a collar or turtleneck may connect to the head opening 34. The arm sleeves 32 and the hood 35 may be attached (i.e., sewn) to the main body 20, or alternatively may be a continuation of the material from the main body 20. As illustrated, a bottom opening 36 is formed at the lower end 24*b*, as is standard for sweatshirts.

As shown in FIG. 1, a pair of opposed slits 38 is formed in the front portion 22*a*. In some embodiments, the pair of opposed slits 38 each include a closure (not shown), e.g., a zipper, hook and loop strips, buttons, a flap, magnets, etc., with or without a flap. Alternatively, the slits 38 may simply be open. In some cases, the opposed slits 38 may be positioned adjacent the side portions 22*c*, so that the wearer's hands may be easily inserted into an internal pocket 40, best shown in FIGS. 2-3 and discussed below.

The sweatshirt may be formed of a fabric material, which may include inelastic or elastic fibers, organic or artificial materials, or a combination thereof. In other embodiments, the sweatshirt may be solid plastic for protection from certain outside elements, or be formed of any other desired types of materials. In some embodiments (not shown), the arm sleeves 32, head opening 34/hood 35, and/or the bottom opening 36 may include a drawstring element, buttons, zippers, etc., as is well-known in the art. While one example of the sweatshirt 20 is illustrated, it should be understood that any feasible size or proportions of sweatshirt will be compatible with the present invention as-claimed.

In some embodiments, an inner pouch 41 may be positioned inside the internal pocket 40. The inner pouch 41 may be sized such that a smart phone may be inserted into the inner pouch, or it may be sized to fit other items commonly stored in pockets, e.g., earbuds, keys, tablets, step counters, etc. In some embodiments, the materials used to form the entirety or portions of the front portion 22*a* and/or the internal pocket 40 may allow the use of a touch screen through the material, without needing to remove the smart phone.

In other, not-illustrated embodiments, more than one inner pouch 41 may be included within the internal pocket 40. Each inner pouch may also include dividers to separate compartments of the pouch (not shown). Furthermore, the internal pocket 40 may include a divider to separate either side of the pocket (not shown). The inner pouch 41 allows for organization of items, prevention of the items from falling out or moving around, and easy retrieval. The existence of the inner pouch 41 may also prevent items from weighing the internal pocket 40 down.

Figure 2:
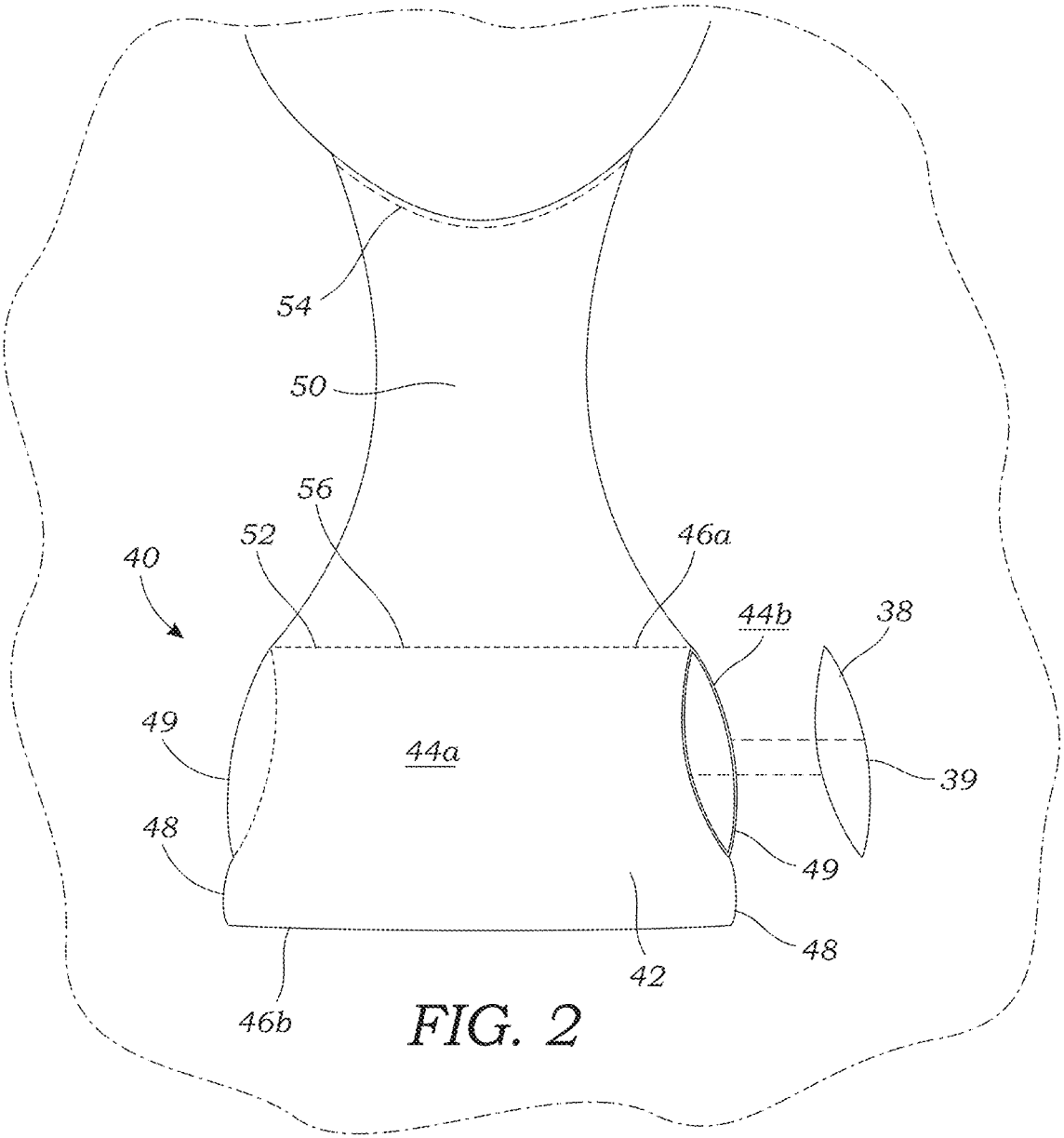
FIG. 2 is a forward facing view from inside the sweatshirt, in a sectional view taken along line 2-2 in FIG. 1, illustrating a flexible liner and a tube of material forming an internal pocket, and illustrating how the tube of material attaches to slits of the sweatshirt.

FIG. 2 is a forward facing view from inside the sweatshirt 10, in a sectional view taken along line 2-2 in FIG. 1, illustrating a flexible liner 50 and a tube of material 42 forming an internal pocket 40, and illustrating how the tube of material 42 attaches to slits 38 of the sweatshirt 10.

Figure 3:
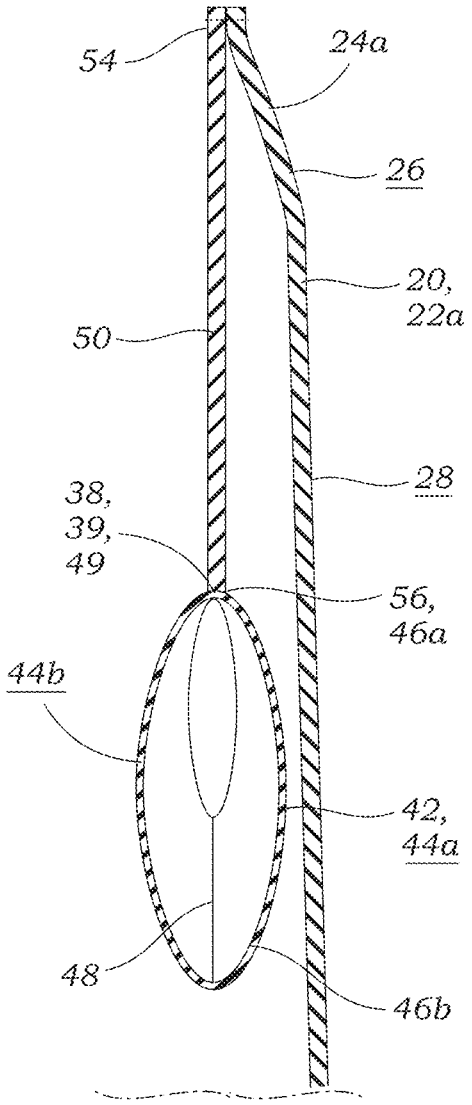
FIG. 3 is a sectional view of the flexible liner and the tube of material, taken along line 3-3 in FIG. 1.

FIG. 3 is a sectional view of the flexible liner 50 and the tube of material 42, taken along line 3-3 in FIG. 1. As shown in FIGS. 2-3, the sweatshirt 10 further includes a tube of material 42 having a front surface 44*a* and a rear surface 44*b* connected with a top portion 46*a* and a bottom portion 46*b*. The tube of material 42 further extends to side edges 48 that form side openings 49 for accessing an internal pocket 40 of the tube of material 42. The tube of material 42 abuts the interior surface 26 of the front portion 22*a* of the sweatshirt 10, but in one embodiment is not fastened to the front portion 22*a* except via the side edges 48, each of the side edges 48 being sewn (e.g., via a slit seam 39) of one of the pair of opposed slits 38, such that the internal pocket 40 can be accessed through the slits 38.

For the purposes of this application, the term "sewn" is defined to include any form of sewing, stitching, and any other equivalent fastening, welding, bonding, or other equivalent known in the art.

The internal pocket 40 may be positioned at or adjacent a center of the front portion 22*a*, which may provide easier access in the case of an "oversized" sweatshirt, wherein the lower end 24*b* extends past the torso of the wearer. However, the internal pocket 40 may be located at any part of the front portion 22*a* for access.

As illustrated, the flexible liner 50 is attached at a bottom edge 52 to the top portion 46*a* of the tube of material 42, and is attached at a top edge 54 to (e.g., sewn to a seam 56) the sweatshirt, in this embodiment at a point adjacent to the head opening 34, such that the flexible liner 50 supports the tube of material 42 between the pair of slits 38.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A sweatshirt adapted to cover a person's torso, comprising:

a front portion, a back portion, and a pair of side portions together forming a main body that extends from an upper end to a lower end and has an interior surface and an exterior surface;

a pair of opposed arm openings in the side portions, a head opening at the upper end, and a bottom opening at the lower end;

a pair of opposed slits formed in the front portion, each slit being adjacent one of the side portions;

a tube of material having a front surface and a rear surface connected with a top portion and a bottom portion, the tube of material extending to side edges that form side openings for accessing an internal pocket of the tube of material;

wherein the tube of material abuts the interior surface of the front portion of the sweatshirt, but is not fastened to the front portion except via the side edges, each of the side edges being sewn to a slit seam of one of the pair of opposed slits, such that the internal pocket can be accessed through the slits; and further comprising a flexible liner that is attached at a bottom edge to the top portion of the tube of material, and is attached at a top edge to a seam adjacent to the head opening, such that the flexible liner supports the tube of material between the pair of slits.

2. The sweatshirt of claim 1, wherein the internal pocket is positioned at or adjacent a center of the front portion.

* * * * *